United States Patent [19]

Druz et al.

[11] 4,166,788

[45] Sep. 4, 1979

[54] METHOD OF CONCENTRATING MAGNETIC ORE AND MAGNETIC CENTRIFUGAL SEPARATOR FOR EFFECTING THE METHOD

[76] Inventors: Efim L. Druz; Jury E. Druz, both of Dnepropetrovskoi oblasti, ulitsa Ordzhonikidze, 36, kv.8, Krivoi Rog, U.S.S.R.

[21] Appl. No.: 748,714

[22] Filed: Dec. 8, 1976

[51] Int. Cl.[2] ..... B03C 1/02; B03C 1/30

[52] U.S. Cl. ..... 209/39; 209/214; 209/223 R; 209/232

[58] Field of Search ..... 209/478, 214, 217, 223 R, 209/224–226, 232, 213, 39; 210/222, 223

[56] References Cited

U.S. PATENT DOCUMENTS

| | | | |
|---|---|---|---|
| 2,904,178 | 9/1959 | Wintermute | 209/232 X |
| 3,289,836 | 12/1966 | Weston | 209/214 |
| 3,595,391 | 7/1971 | Schmid | 209/225 |
| 3,988,240 | 10/1976 | Fraas | 209/214 |
| 4,017,385 | 4/1977 | Morton et al. | 209/214 |

*Primary Examiner*—Ralph J. Hill

[57] ABSTRACT

The method of concentrating magnetic ore consists of forcing a fluid medium to flow along guides having curved and rectilinear portions; and directing the flow by a pulsating magnetic flux, so that the heavy magnetic particles are forced towards the outer side of the guides. Less heavy particles of the nonmagnetic fraction are washed away by the flow of a fluid medium. In the curved portions of the guides, the magnetic flux coincides in direction with the centrifugal force; in the rectilinear portions of the guides, there is no centrifugal force and the magnetic flux is directed at right angles to the flow of the ore to be concentrated. The magnetic centrifugal separator includes and air-tight housing having curved portions alternating with rectilinear portions. Sources of magnetic flux are located on these portions of the housing. Means are provided to cause the magnetic flux to pulsate.

9 Claims, 12 Drawing Figures

METHOD OF CONCENTRATING MAGNETIC ORE AND MAGNETIC CENTRIFUGAL SEPARATOR FOR EFFECTING THE METHOD

FIELD OF THE INVENTION

The present invention relates to equipment for the mining industry used in the process of magnetic ore concentration, and, more particularly, to methods of magnetic ore concentration and magnetic centrifugal separators for the concentration of magnetic ores.

The disclosed method of concentrating magnetic ores and the magnetic centrifugal separator realizing same can be preferably used for wet and dry concentration of both strongly magnetic and weakly magnetic (oxidized) iron, chrome iron and manganese ores.

DESCRIPTION OF THE PRIOR ART

There is known a method of concentrating magnetic ore and a magnetic separator for effecting said method (cf. USSR Inventor's Certificate No. 430,889 of Jan. 22, 1971) intended for wet concentration of strongly magnetic ores which comprises a stationary air-tight separator box of helical shape, wherein there are contained rotary sources of magnetic flux and through which there moves due to the action of water a flow of the ore to be concentrated, a feed pipe and outlet pipes for the discharge of magnetic and nonmagnetic fractions with the aid of a controllable baffle plate arranged at the end of the helix. When the flow of the ore to be concentrated is pressure-fed into the helical separator box, it is exposed to the action of centrifugal forces and of the magnetic flux produced by the rotary sources, these actions being directed in opposite directions. The ore to be concentrated travels through the helical box in a counter-current flow relative to the direction of rotation of the sources of magnetic flux. While the centrifugal forces throw the magnetic fractions towards the outward wall of the separator box, the sources of magnetic flux attract said fractions to the inward wall of the box, causing it to move in a counter-current flow relative to the flow of the concentrated ore towards the discharging arrangement. At the same time, the centrifugal forces throw the nonmagnetic fractions towards the outward wall of the separat or box, thereby causing the velocity head of the flow of the ore to be concentrated to move said fraction towards the discharging arrangement at the end of the helical box. Travelling along the inward wall of the separator box towards the discharging arrangement, the magnetic fractions leave the zone wherein they are acted upon by the rotary sources of magnetic flux and join the flow of the nonmagnetic fractions with the result that said flow causes the flow of the magnetic fractions to change its direction by as much as 150 degrees so that the controllable baffle plate separates the magnetic fractions which leave the box through one of the outlet pipes. The nonmagnetic fractions travel along the other side of the baffle plate and are discharged through the other outlet pipe.

However, the separation of the layer of magnetic fractions in accordance with the known method, wherein said fractions are acted upon by centrifugal forces directed towards the outward wall of the separator box, calls for the use of highly intensive sources of magnetic flux in the separator. This, in turn, leads to an intensive flocculation of the magnetic fractions producing floccules so bit that particles of the nonmagnetic fractions are carried away by the floccules as they are moving from the outward wall to the inward wall of the separator box in the course of flocculation. Rotating at a low rate, the sources of magnetic flux are incapable of destroying the floccules of magnetic fractions when they roll over the inward wall of the helical box, dragging along with them particules of nonmagnetic fractions. Only a small, practically insignificant, part of the nonmagnetic fractions carried away by the floccules is thrown by the centrifugal forces towards the outward wall of the helical separator box.

Another disadvantage of both the method of concentrating magnetic ore described above and of the known separator is the necessity of urging the magnetic fractions to travel along the inward helical wall of the box in a counter-current flow relative to the flow of the ore to be concentrated. This calls for increasing the intensity of the sources of magnetic flux and eliminates the possibility of concentrating weakly magnetic ore.

A further disadvantage of the known method is that the travelling magnetic flux produced by the rotary sources of magnetic flux, located in the separator realizing said method behind the inward wall of the helical separator box, recurs at a low rate. The fact that the magnetic flux is pulsating at a low rate renders the destruction of big floccules impossible with the consequence that these floccules drag away particles of nonmagnetic fractions. An increase in the rate of rotation of the sources of magnetic flux is impractical due to the vibration, because such vibration would make it unlikely that an accurate dynamic balancing of the bulky unit comprising the sources of magnetic flux is achievable.

An additional disadvantage of the known design is the necessity of diverting the direction of travel of magnetic fractions through an angle of 150 degrees when said fractions are being discharged from the helical separator box by means of the flow of nonmagnetic fractions moving at a high speed. This results in the intermixing of the products already separated, low selectivity of the concentration process and loss of magnetic fraction with tailings.

Owing to the disadvantages mentioned, the magnetic separator of the known design based on the above method fails to provide control of the process of concentrating strongly magnetic ores, so that the content of magnetic fractions in both the concentrate and tailings cannot be changed as required, is unsuitable for the concentration of weakly magnetic ores and serves the purpose of separating the flow of a strongly magnetic concentrated ore into only two products with a selectivity of a low order.

SUMMARY OF THE INVENTION

It is an object of the present invention to provide a method of concentrating magnetic ores and a separator effecting said method, wherein by virtue of simple design a controllable separation of the flow of a magnetic ore are concentrated into several products, the yield of the products of concentration having a controllable content of the magnetic fraction under the conditions of high selectivity of the concentration process and the concentration of weakly magnetic ores.

These and other objects are attained by a method of concentrating magnetic ore, consisting of the steps of interacting an external magnetic field with the magnetic field of the flow of the ore to be concentrated along with a centrifugal force acting thereon, forcing the flow of the magnetic ore to be concentrated to move, in accordance with the invention, along guides featuring curved convex and rectilinear portions, and directing the flow within said portions, by having a pulsating magnetic flux act upon it, so that within the curved portions of the guides the resultant force due to the interaction of the magnetic fields and the centrifugal force are both directed in the same direction, thereby forcing the heavy magnetic particles towards the outer side of the guides, a layer of magnetic fraction being built up, at said outer side within the rectilinear portions of the guides, the resultant force due to the interaction of the magnetic fields being directed at right angles to the direction of the flow of the ore to be concentrated, thus causing the layer of the magnetic fraction formed to recurrently come to a halt and consequently slowing the layer down at the outer side of the guides, while the layer of particles of the nonmagnetic fraction and some of the concentrations of mineral are transported by a flow of a fluid medium at a relatively higher speed with the result that the difference in the speed at which the layers of different fractions travel in the flow of the ore to be concentrated enhances the selectivity of the process of magnetic ore to be separation. The magnetic centrifugal separator realizing said method comprises a stationary air-tight separator box, there moves by means of a fluid medium the flow of the ore to be concentrated and sources of the magnetic flux interacting with the flow of the ore concentrated. The separator box is made, according to the invention, of a nonmagnetic material and features curved convex portions alternating with rectilinear ones. All the sources of magnetic flux are disposed outside the separator box, some of these sources being located at the curved portions of the separator box and producing a magnetic flux which coincides in direction with the direction of centrifugal forces and other sources being located at the rectilinear portions of the separator box and producing a magnetic flux which is directed at right angles to the direction of travel of the straightened flow of the ore concentrated. Interposed between the separator box and the sources of magnetic flux is an interrupter of magnetic flux generating a pulsating magnetic flux which builds up the layer of a magnetic fraction in the flow of the ore to be concentrated at the outer wall of the separator box. Provided at the end of at least the first rectilinear portion there is an outlet pipe with a controllable gate for the discharge of said fractions in the form of a concentrate, the subsequent rectilinear portions being provided with separate outlet pipes fitted with controllable gates for the discharge of intermediate products and tailings. The number of rectilinear portions is determined by the number of magnetic fractions discharged at the end of each such rectilinear portion.

It is expedient that in the magnetic centrifugal separator for the concentration of magnetic core, the interrupter of magnetic flux is provided in the form of a multi-section unit, some of the sections being arranged at the curved portions of the separator box and the rest, other sections being arranged at the rectilinear ones.

Each section of the interrupter of magnetic flux can be made of the form of a moving endless belt in a nonmagnetic material with ports. Transverse separations between the ports are made of a magnetic material. The size and rate of travel of the ports control the duration of the pulses of magnetic flux which build up the layer of the magnetic fraction and contribute to the reduction of the size of the floccules in said layer. The sections of the interrupter of magnetic flux located at the curved portions of the separator box can be jointed to form a unitary cylinder surrounding all the curved portions of the housing.

The sections of the interrupter of magnetic flux located at the rectilinear portions of the separator box are preferably made elliptical.

The sections of the interrupter of magnetic flux located at the curved portions of the separator box can be given a shape corresponding to the contours of these portions.

The sections of the interrupter of magnetic flux can be provided with individual controllable drives in order to impart rotary movement thereto.

The sections of the interrupter of magnetic flux can be provided with individual controllable drives in order to impart reciprocative movement to that section of the interrupter.

It is preferable to provide the sections of the interrupter of magnetic flux with one common controllable drive.

In the magnetic centrifugal separator for the concentration of magnetic core it is preferred that those of the sources of magnetic flux which are located at the rectilinear portions of the separator box are made controllable, thus enabling the control of the content of the magnetic fraction in the concentrate by changing the strength of magnetic field.

Moreover, sources of magnetic flux with interrupters can be provided downstream of the outlet pipes, thereby facilitating the separation of the layer of the magnetic fraction and the transportation of them to the outlet pipes.

It is preferable that at least one step widening in the direction of flow of the ore to be concentrated be provided inside the air-tight separator box of the magnetic centrifugal separator and that a slot be provided in the end face of said step into which there is admitted a concurrent flow of an ascending stream of another fluid medium serving to wash the magnetic fraction and to discard the nonmagnetic fraction of the flow of the ore to be concentrated. Said step can be located at the junction between a curved portion and a rectilinear portion of the separator box or upstream of the outlet pipes from which there are discharged the concentrate and middlings. It is preferred that a longitudinal partition preventing the intermixing of the magnetic and nonmagnetic fractions in the flow of the ore to be concentrated be provided downstream of said step.

It is also preferred that additional sources of magnetic flux with interrupters be provided in the magnetic centrifugal separator at the inner side of the separator box and that an additional outlet pipe with a controllable gate be provided at its inner side.

The separator of the above construction is capable of a controllable separation of the flow of magnetic ore into several products, yields products of concentration with a controllable content of the magnetic fraction and is suitable for the concentration of weakly magnetic ores.

BRIEF DESCRIPTION OF THE DRAWINGS

The present invention will be best understood from the specific embodiments which will be now described by way of example with reference to the accompanying drawings in which.

DETAILED DESCRIPTION OF THE DRAWINGS

The disclosed method of concentrating magnetic ore will now be described in detail by way of example by considering the operation of a magnetic separator for effecting said method.

Figure 1:
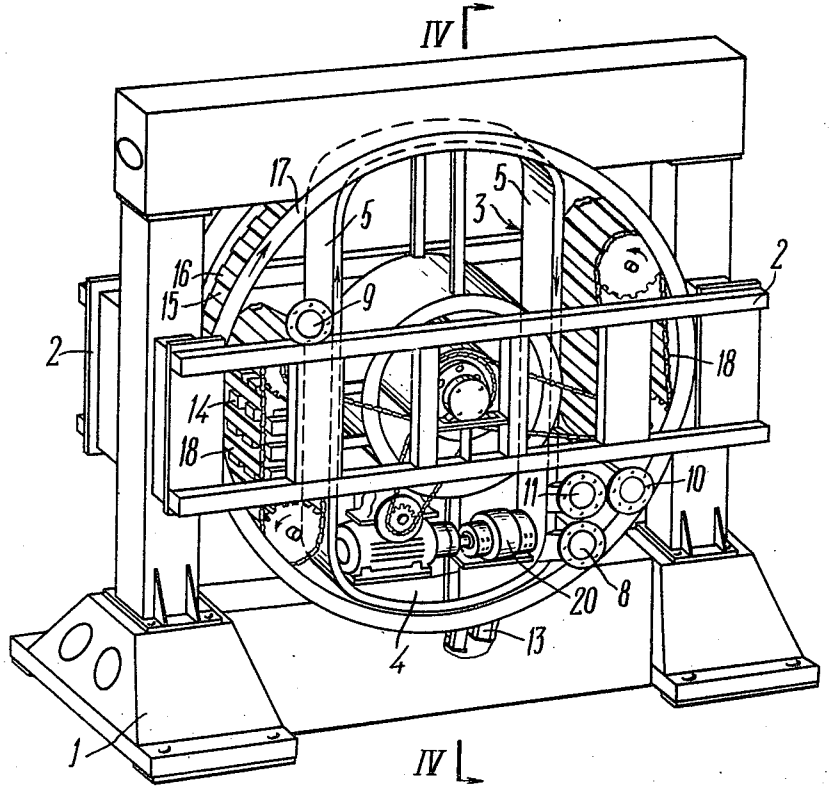
FIG. 1 is a perspective view of the magnetic centrifugal separator for the concentration of magnetic ores in accordance with the invention.

Referring to FIG. 1, the disclosed magnetic centrifugal separator effecting the disclosed method of concentrating magnetic cores, essentially consists of an upright frame I, the posts of which having brackets 2 attached on both sides, one of the brackets 2 serving to support a stationary air-tight separator box 3 attached to one of the posts on only one side. The separator box 3 is made of a nonmagnetic material and features curved portions 4 along with rectilinear portions 5. The number of said portions may vary depending on the number of the magnetic fractions being discharged from the separator at the end of each said portion. For the sake of simplicity, the separator illustrated in the accompanying drawings has just two portions of each kind.

Figure 2:
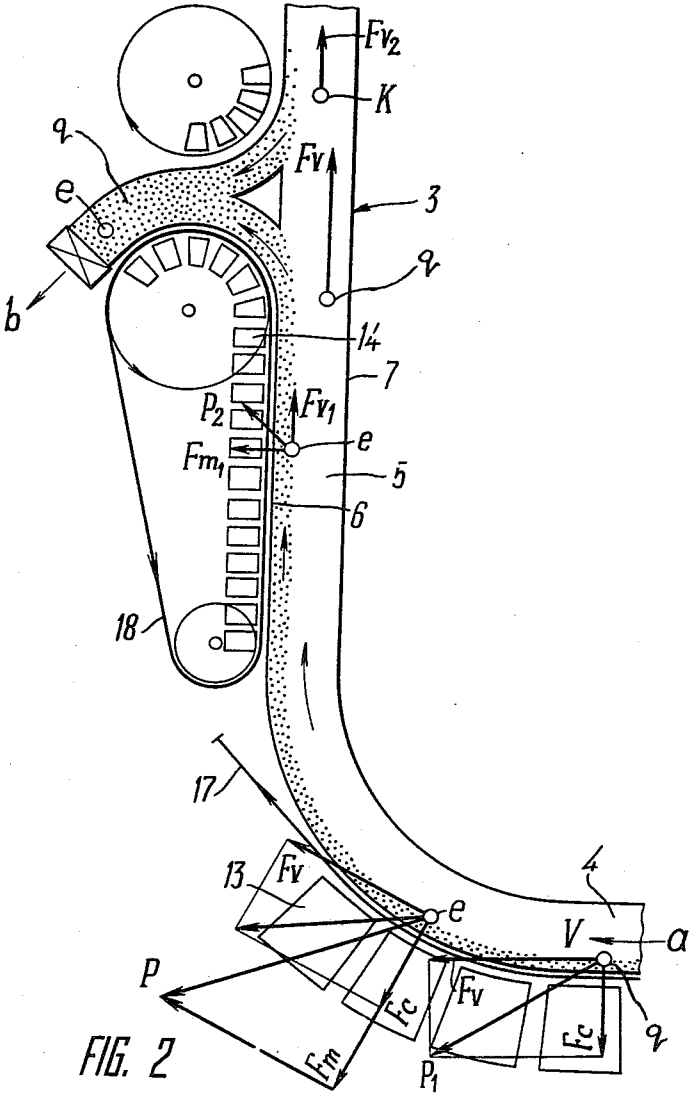
FIG. 2 is a kinematic diagram illustrating the manner in which the various particles of the ore to be concentrated move inside the separator box.

Referring to FIG. 2, the separator box has an outer wall 6 and an inner wall 7. One of the curved portions of the separator box 3 is provided with an inlet pipe 8 (see FIG. 3) into which there is introduced under pressure a flow of a ore to be concentrated in the form of a fluid medium. At the end of one of the rectilinear portions 5 there is provided an outlet pipe 9 into which there is discharged a concentrate. At the end of the other rectilinear portions there are provided two outlet pipes 10 and 11 for the discharge of the middlings and tailings, respectively. The cross-section of the pipe 10 is equal to that of the pipe 8. All of the outlet pipes 9, 10 and 11 are fitted with controllable gates 12.

Figure 3:
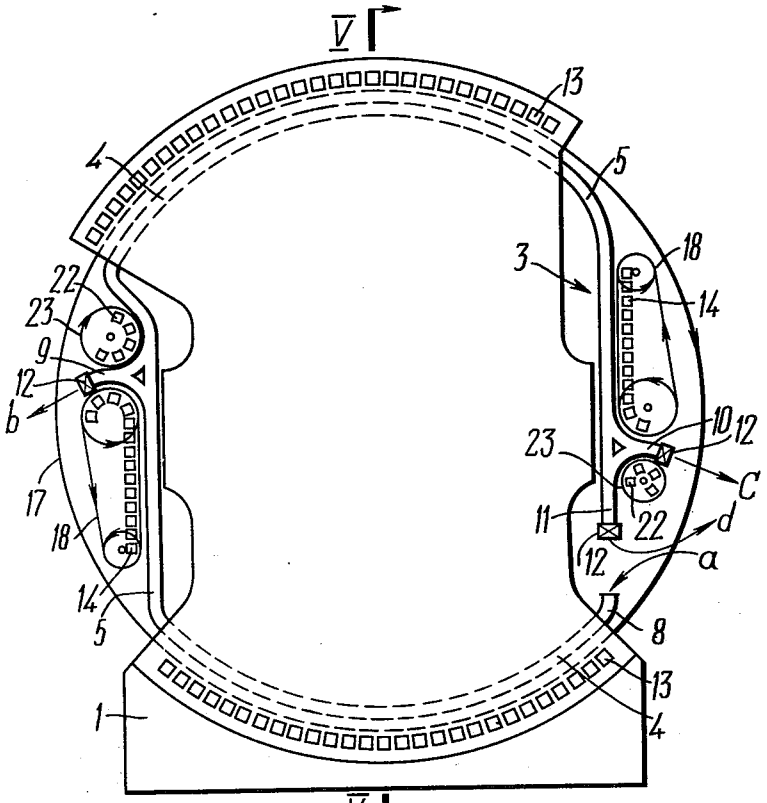
FIG. 3 is a schematic elevational diagram of the magnetic centrifugal separator according to the invention.
Figure 4:
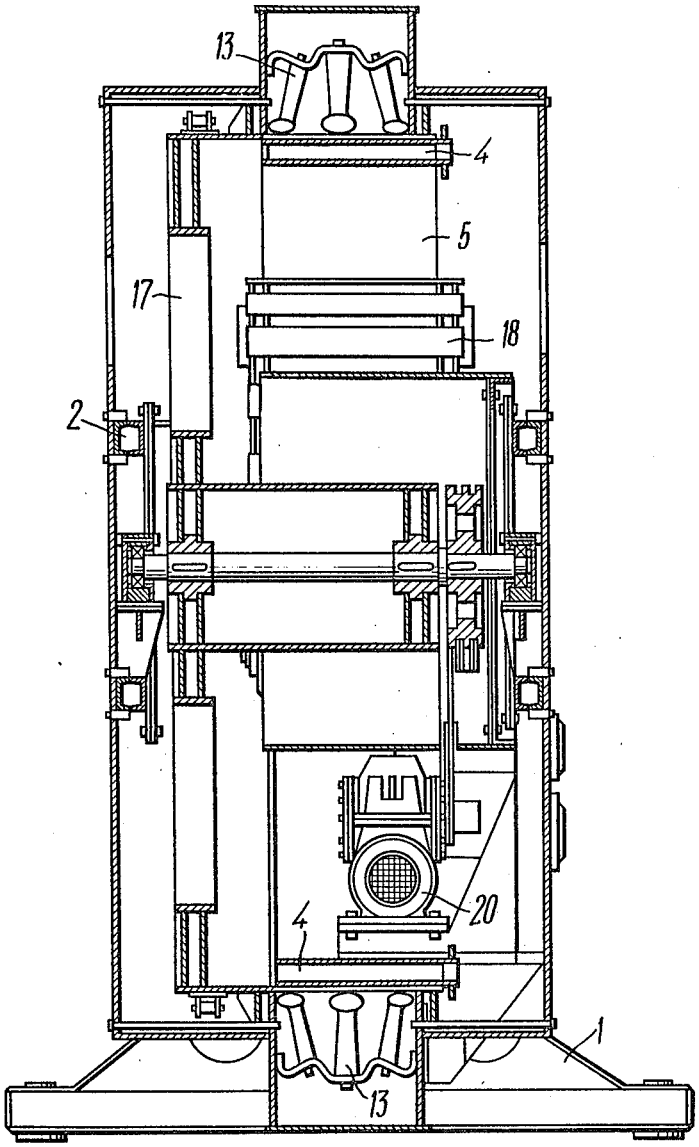
FIG. 4 is a cross sectional view of the magnetic centrifugal separator according to the invention taken along the line IV—IV of FIG. 1.

Referring to FIGS. 3 and 4, the curved portions 4 of the separator box 3 are provided with sources 13 of a permanent magnetic flux located along the outer side of said portions. At the outer sides of the rectilinear portions 5 of the box 3 are sources 14 of another permanent magnetic flux. The sources 13 of magnetic flux are immovably attached to the frame I and the sources 14 of magnetic flux are attached to the bracket 2 by one of their sides. Interposed between the portions of the separator box 3 and the sources 13 and 14 of magnetic flux is a multi-section interrupter of magnetic flux.

Figure 5:
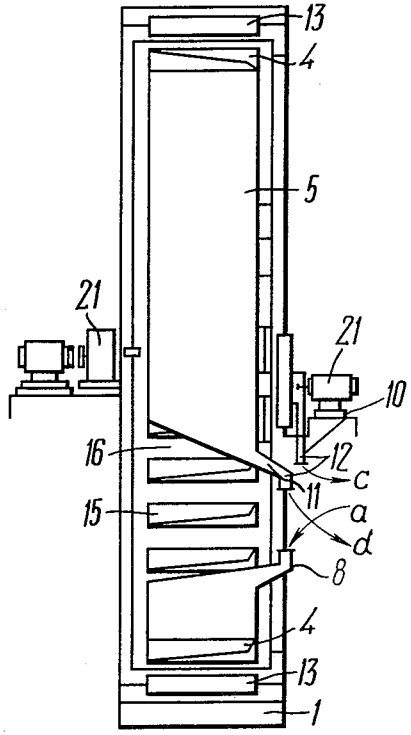
FIG. 5 is a cross sectional view of the magnetic centrifugal separator according to the invention taken along the line V—V of FIG. 3.
Figure 6:
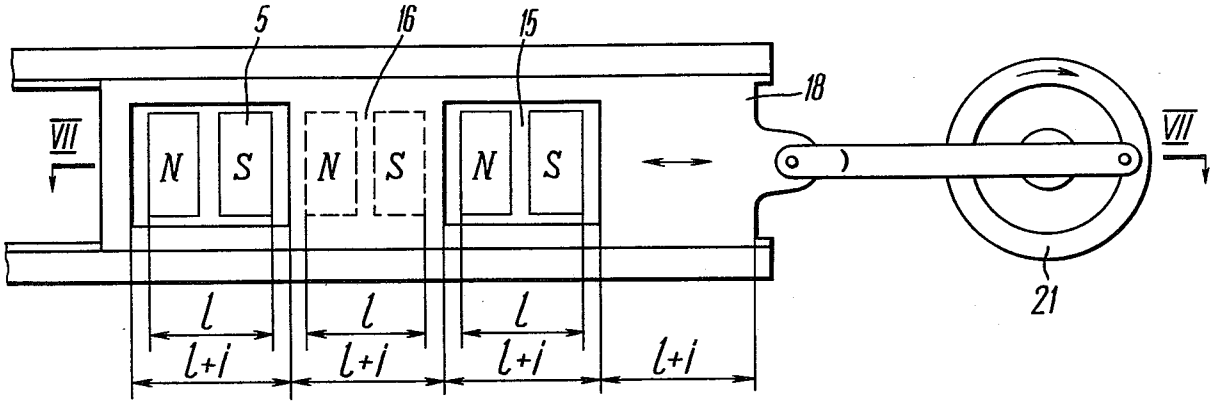
FIG. 6 is a longitudinal view of the interrupter of magnetic flux according to the invention.
Figure 7:
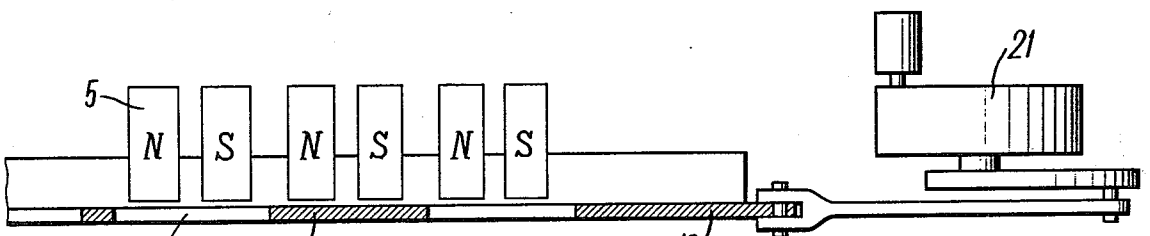
FIG. 7 is a longitudinal cross sectional view of the interrupter of magnetic flux according to the invention taken along the line VII—VII of FIG. 6.

Referring to FIG. 5, each section of the interrupter of magnetic flux is provided in the form of a moving endless belt made of a nonmagnetic material and having ports 15. Transverse separations 16 between the ports 15 are made of a magnetic material. As shown in FIG. 6 the width of each port 15, which is $l+i$, and the distance between the adjacent separations, which is also $l+i$, must be greater than the distance $l$, between the extremities of adjacent magnet poles or the width of a group of magnets, i.e., $l+i>l$.

Figure 9:
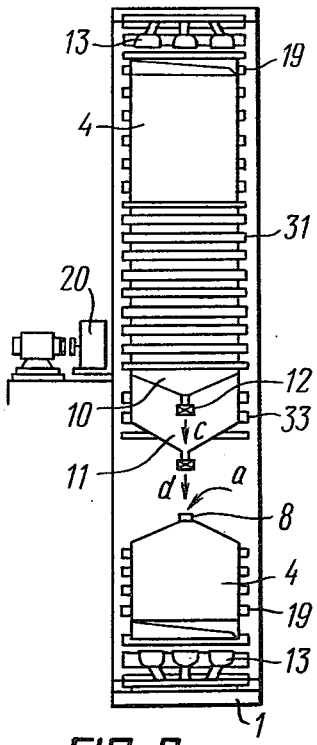
FIG. 9 is a cross sectional view of the magnetic separator according to the invention taken along the line IX—IX of FIG. 8.

It will be noted that one of the sections, shown at 17, of the interrupter has the shape of a cylinder and surrounds all the curved portions 4 of the separator box 3. Said section 17 is attached to one of the brackets 2 on one of its sides. Another section of the interrupter of magnetic flux, shown at 18 in FIG. 2, has an elliptical shape and two such sections are fitted at the rectilinear portions 5 of the separator box 3. Each of the curved portions 4 of the separator box 3 can be provided with an individual interrupter 19, shown in FIGS. 8 and 9, which corresponds to the contours of said portions.

In the described example of the magnetic centrifugal separator, all the sections of the interrupter of magnetic flux are provided with a common controllable drive 20 (FIG. 1) which imparts rotary movement to each of the sections. However, each of the sections comprising the interrupter may be provided with an individual controllable drive 21 (FIGS. 5 and 6) to provide for either rotation or reciprocation of that section.

To enable control of the content of the magnetic fraction in the concentrate, some of the sources 14 of magnetic flux disposed at the rectilinear portions 5 of the separator box 3 are made controllable, i.e., either said sources can be moved relative to the separator box 3 or the strength of the magnetic field set up by the sources 14 can be changed. To provide for the recovery of a layer of the magnetic fraction and to facilitate further motion of said layer towards the outlet pipes 9 and 10, sources 22 of magnetic flux with interrupters 23 are provided downstream of said outlet pipes.

Figure 11:
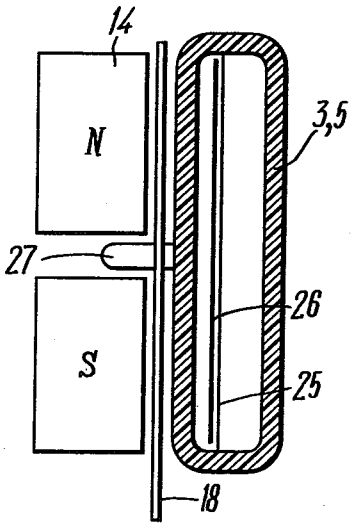
FIG. 11 is a cross sectional view of the separator box according to the invention taken along the line XI—XI of FIG. 10 illustrating the end face of the step.
Figure 10:
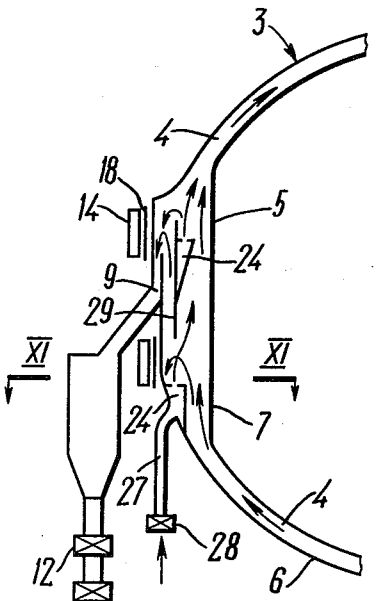
FIG. 10 is a longitudinal view of the separator box according to the invention at the place where the step and partition are installed.

Referring to FIG. 10, a step 24 widening in the direction of flow of the ore to be concentrated is provided inside the air-tight separator box 3. An end face 25 (FIG. 11) of said step 24 is provided with a slot 26 into which there is admitted in a concurrent flow an ascending current of another fluid medium, thereby facilitating the process of separating the flow of the magnetic fraction. Water is introduced through a pipe 27 and its flow is controlled by a valve 28.

In the described example of the disclosed separator, the step 24 is located upstream of the outlet pipe 9, downstream of said step there being provided a longitudinal partition, serving to prevent the intermixing of the magnetic and nonmagnetic fractions separated by means of said step. Further, the step 24 can be located at the junction between one of the curved portions 4 and the respective rectilinear portion 5 of the separator box 3 or elsewhere in the separator box, this and other possible arrangements of the step being shown.

Figure 8:
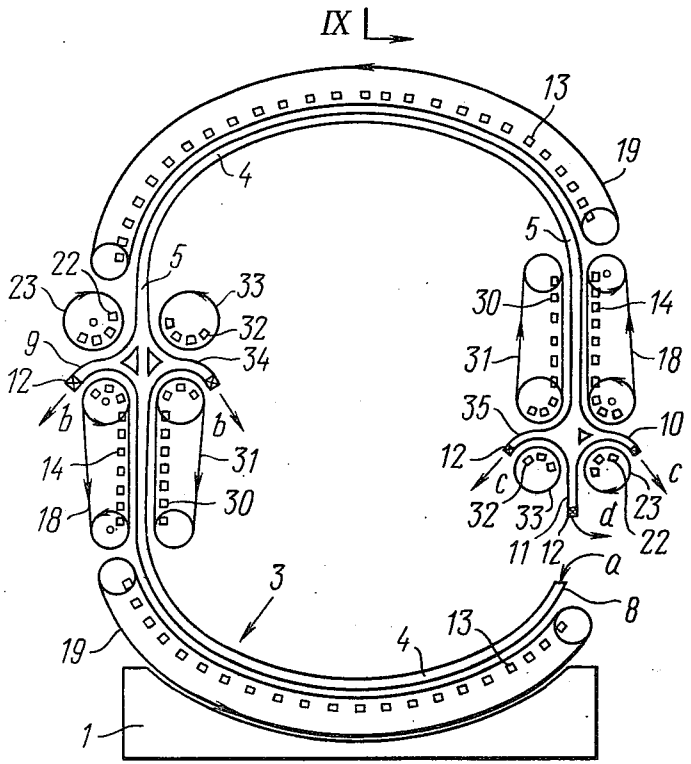
FIG. 8 is a schematic elevational diagram of the magnetic centrifugal separator for the concentration of magnetic ores showing the sources and interrupters of magnetic flux located at the inner side of the separator box according to the invention.

Apart from that, each portion of the separator box 3 can be provided with additional sources 30 and 31 of magnetic flux arranged, along with interrupters 32 and 33 of magnetic flux, at the inner side of the separator box 3 (see FIG. 8). This is effective for recovering the fine magnetic fraction from the flow of the ore to be concentrated, building up a layer of said fraction at the inner wall of the separator box 3 and discharging the layer through outlet pipes 34 and 35 arranged, along with controllable gates 12, at the inner side of the separator box 3. Moreover, said arrangement permits a reduction of the strength of the magnetic field set up by the sources located at the outer side of the separator box 3 and protects the inner wall of the box 3 from intensive wear.

Figure 12:
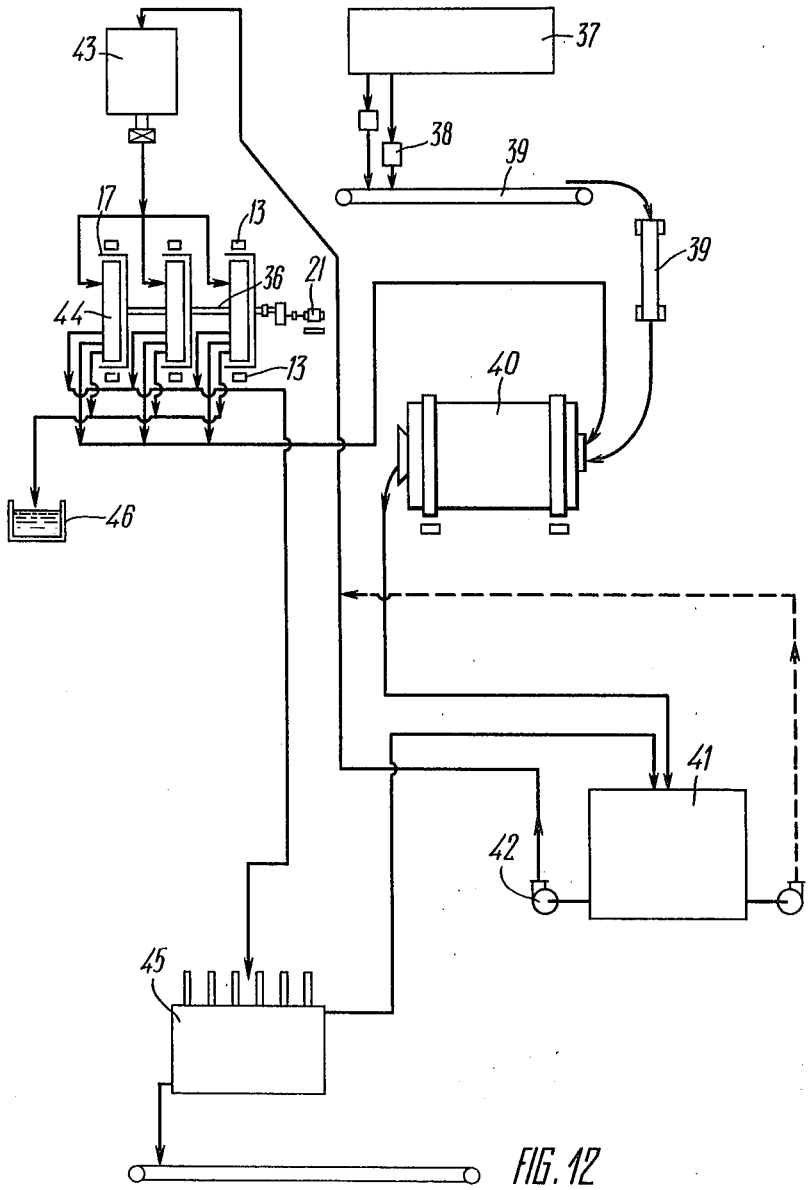
FIG. 12 is a flow diagram of a plant equipped with the disclosed separators for concentration of magnetic ore.

Referring to FIG. 12, which is a flow diagram of a plant for the concentration of magnetic ores, a number of magnetic centrifugal separators operating in parallel by means of a common shaft 36 can be employed. By virtue of the separator disclosed, the flow diagram is much simpler than ever before. A crude ore hopper 37 is connected to an ore mill 40 by means of feeders 38 and belt conveyors 39. The mill 40 feeds one of the magnetic centrifugal separators 44 through a sump 41, a pump 42 and a header tank 43 so that the flow of the ore to be concentrated is under a constant pressure. The separator 44 is linked up with the mill 40, a vacuum filter 45 and a tailings chute 46.

The disclosed magnetic centrifugal separator for the concentration of magnetic ores operates according to the following principles.

A flow "a" (FIG. 3) of the magnetic ore to be concentrated is fed under a constant pressure from the header tank 43 (FIG. 12) into the inlet pipe 8 (FIG. 3). As the flow "a" of the ore to be concentrated moves over the curved portion 4 of the separator box 3, it is acted upon by the centrifugal forces $F_c$ (FIG. 2) directed towards the outer wall 6 of the separator box 3 and the magnetizing forces $F_m$ which coincide in direction with the centrifugal forces $F_c$. During this stage, the particles of the nonmagnetic fraction "q" are exposed to the action of only the centrifugal forces $F_c$, whereas the particles of the magnetic fraction "e" are subjected to the action of both the centrifugal forces $F_c$ and the magnetizing forces $F_m$. The absolute value of the magnetizing forces $F_m$ acting on the magnetic particles "e" vary with the strength of the magnetic field which, although decreasing across the separation box 3 in the direction towards its inner wall 7, must be sufficiently high so as to enable the fine fraction of magnetic particles to cover the distance between the inner wall 7 and the outer wall 6 of the separator box 3.

The force $F_v$ of the velocity of the flow "a" of ore to be the concentrated varies with design features of the separator, the maximum coarseness of the particles in the flow and the mass thereof as well as with the losses of the velocity and must be kept in each particular case at the maximum allowable level.

An inherent feature of the separator disclosed is that the optimum rates of flow therein can be kept, by virtue of its design, at fairly high levels, particularly when the dry benefication of magnetic ore is the process wherein rates of flows in excess of 20 m/sec are quite acceptable. As a result, for example, a 0.01 $cm^3$ particle of the magnetic fraction from magnetic or hematite ore with a bulk weight anywhere between 5.1 and 5.3 $g/cm^3$ will be acted upon, while travelling over the curved outer wall 6 of the separator box 3, the radius thereof being 1000 mm, by a centrifugal force of 3.1 nt whereas the centrifugal force acting on a particle of the same volume but being of the nonmagnetic fraction, say quartz, with a bulk weight of 2.7 $g/cm^3$, will be eqaul to 1.05 nt, i.e., constituting only $\frac{1}{3}$ of the former value.

This implies that, within each curved portion 4, the coarser particles "e" of the magnetic fraction will be pressed towards the outer wall 6 of the separator box 3 by a resultant force P with the result that the particles "q" of the nonmagnetic fraction subjected to the action of a much lesser resultant force $P_1$ will be expelled to the surface of the magnetic fraction, both vectors P and $P_1$ being directed in the direction of travel of the flow "a" of the ore to be concentrated.

As far as the fine fraction is concerned, the reactions of the magnetic and nonmagnetic particles "e" and "q", respectively, to the action of the centrifugal forces $F_c$ and that of the magnetizing force $F_m$ are different, although this difference is only slight. Taking this into account, the force $F_v$ of the velocity of the ore to be concentrated must be accurately correlated with the sources 13 of magnetic flux with due regard to the difference in the resultant forces acting on the fine magnetic and nonmagnetic fractions.

In the specific embodiment of the magnetic centrifugal separator for wet benefication of strongly magnetic ore, the rate of flow of the fluid medium at the inlet is specified to be 3.4 m/s and the magnetic field strength at the inner wall 7 of the separator box 3 is adopted to be 600 oersteds. The forces $F_v$, $F_{v1}$ and $F_{v2}$ of the velocities of the flows "a", "e" and "k" inside the separator box 3 lend themselves to control over a wide range by adjusting the discharge of the products "b", "c" and "d" of concentration through the outlet pipes 9, 10, 11 with the aid of the controllable gates 12 fitted thereto depending on the length of the interval during which the magnetic flux produced by the sources 13 acts on the ore to be concentrated as the ore travels along each of the curved portions 4 of the separator box 3.

Owing to the action of the interrupter 17 moving at a certain rate, the magnetic flux produced by the sources 13 is transformed into a pulsating one. At the instant when some of the magnetic separations 16 (FIG. 5) are located above adjacent magnets of each of the sources 13, they complete the magnetic circuit so that the action of the magnetic flux on the flow of the ore to be concentrated ceases to exist as said flow travels over the respective curved portion 4. But as soon as ports 15 come into a position above these adjacent magnets of each of the sources 13, the action of the flux on the flow of the ore to be concentrated is resumed, with the magnetic field strength being at its maximum.

It thus stands to reason that within the duration of a pulse the magnetic fraction "e" of the flow of the ore to be concentrated travelling in the space of each of the curved portions 4 is exposed to the magnetic flux so that a minute quantity is attracted to the outer wall 6 (FIG. 2) with the force $F_m$. Simultaneously, the particles "e" of the magnetic fraction are also pressed towards the outer wall by the centrifugal forces $F_c$. In contrast to that, the particles "q" of the nonmagnetic fraction are only pressed to the outer wall 6 by the centrifugal forces $F_c$ and, since the resultant force P acting on the particles "e" is stronger than the resultant force $P_1$ acting on the particles "q", these latter particles will be expelled by the former fraction to the surface of the layer of the magnetic fraction. When a particle "q" comes to the surface of the minute quantity of the magnetic fraction brought to a halt, it is carried away by the flow "a" of the ore to be concentrated travelling above said quantity at a speed V which is a higher one.

As soon as the pulse of magnetic flux ceases to exert its action on the minute quantity of particles "e", it is displaced by the flow "a" of the ore to be concentrated to the next magnet of opposite polarity in the source 13 of magnetic flux. The size of minute quantities of the particles "e" varies directly with the strength of the magnetic field and inversely with the duration of the pulse of magnetic flux. The duration of this latter pulse is controlled by the rate of movement of the interrupter 17 of magnetic flux, and the amount of nonmagnetic particles "q" carried away by each minute quantity of magnetic particles "e" depends on the size of this minute quantity.

In the separator of the design disclosed, the process of forming minute quantities of the magnetic fraction "e" lends itself to control over a wide range so as to build up to a certain height the layer of the magnetic fraction displaced by the flow "a" of the ore to be concentrated over the outer wall 6 of the separator box 3 and towards the rectilinear portion 5. At the same time, particles "q" of the nonmagnetic fraction are washed out of the layer of magnetic particles by the flow "a" of the ore to be concentrated and transported towards the rectilinear portion 5 of the separator box 3. Since the rate of travel of the layer of the magnetic fraction advancing along the outward wall 6 is relatively low, compared with the rate of travel of the flow "a" of the ore to be concentrated, said layer serves to safeguard the outer wall 6 against rapid wear.

Within the space inside each of the rectilinear portions 5 of the separator box 3 (FIG. 2) the action of centrifugal forces on the flows transported ceases to exist, and said flows are induced to move only by the velocity. While the layer of the magnetic fraction is kept moving at the outer wall 6 by the force $F_{V1}$ of the velocity, the particles "q" of the nonmagnetic fraction are transported through the rest of the space in the rectilinear portion 5 by the force $F_v$ of the velocity, this latter force being stronger than the former force $F_{v1}$.

The layer of the magnetic fraction essentially comprises released grains of the magnetic mineral and concretions consisting of the magnetic mineral and a nonmagnetic one. The space inside each of the rectilinear portions 5 is exposed, almost over its entire length, to the action of a pulsating magnetic flux produced by the respective stationary source 14 in cooperation with the respective elliptical interrupter 18 moving at a certain rate. Said system can be moved closer to, or farther from, the outer wall 6 of the separator box 3, using a controllable drive, so that the strength of the magnetic field in the rectilinear portion 5 is changed.

If the pulsating magnetic flux is a weak one, the force $F_{m1}$ (FIG. 2) will be sufficiently strong to attract to the outer wall 6 of the separator box 3, for example, only the released particles "e" of the magnetic fraction while the more bulky concretions K will be washed out of the layer of said particles "e" so built up and carried away by the force $F_{v2}$ of the velocity. At this stage, the released particles of the magnetic mineral continue to travel due to the speed $F_{v1}$ of the velocity, and the resultant vector $P_2$ of all forces coincides in direction with the direction of travel of the released particles "e" of the magnetic mineral. The nonmagnetic fraction is transported at the speed V which is a high one.

When the gate 12 of the outlet pipe 10 (FIG. 3) is widely open while the gate 12 of the outlet pipe 9 (FIG. 2) is opened a little, released particles "e" of the magnetic mineral in pure form will be discharged through the pipe 9 due to the velocity of the flow "a" of the ore to be concentrated set up inside the separator box 3. A further opening of the gate 12 in the outlet pipe 9 will cause concretions K to discharge with the concentrate "b" through said pipe, thereby decreasing the content of the magnetic fraction therein. Summing up, the content of magnetic mineral in the concentrate "b" can be controlled by changing the strength of the magnetic field in the space inside the rectilinear portion 5, the rate of pulsating of magnetic flux, the rate of flow of the fluid medium within said portion and the area of passage of the gate 12. A selectivity of a high order in concentrating strongly magnetic ores is achievable by applying a weak magnetic flux to the rectilinear portion 5 of the separator box 3.

In light of the fact that within the curved portions 4 of the separator box 3 the magnetic fraction "e" of weakly magnetic ores is exposed to the combined action of the centrifugal and magnetizing forces coinciding in direction, the building up of a layer composed of magnetic particles "e" belonging to a weakly magnetic ore is a practical possibility. On reaching the outer wall 6 of the adjacent rectilinear portion 5, the particles "e" of the magnetic fraction from a weakly magnetic ore are brought to a halt from time to time due to the action of the sources 15 producing a controllable and strong magnetic field, accumulate in the outlet pipe 6 and are discharged through the gate 12, being induced by the velocity head $F_v$ of the flow "a". This offers the prospect of concentrating weakly magnetic oxidized iron, manganese and chrome iron ores in the separator of the disclosed design.

Inside the other curved portion 4 of the separator box 3 (FIG. 3), wherein the concretions K and the nonmagnetic fraction "q" are carried by the flow "a" at the speed V, the operation of separating the concretions K into the layer of the magnetic fraction K is repeated along the same principles as in the first curved portion 4 as described hereinabove. Next, the concretions K are brought to a halt at the outer wall 6 of the second rectilinear portion 5 due to the action of the source 14 and the interrupter 18 of magnetic flux while the layer K goes on travelling along the outer wall 6 towards the outlet pipe 10, being induced thereto by the force $F_v$ of the velocity of the fluid medium. The middlings C accumulated in the outlet pipe 10 are fed to the mill 40 (FIG. 12) through the controllable gate 12 for rereduction. The nonmagnetic fraction "q", by analogy with the first rectilinear portion 5, is separated due to the action of the flow "a" of the fluid medium travelling at the high speed V and discharged through the outlet pipe 11 and the controllable gate 12. The discharge of the middlings "c", which is in fact the third intermediate product yielded by the magnetic centrifugal separator, is conducive to the reduction of the waste of the magnetic fraction with the tailings "d" to a considerable extent.

The controllable ascending current of water intersecting the flow of the magnetic fraction "e", which is displaced in the direction of the step 24 (FIG. 10) to the source 14 of magnetic flux, diverts the nonmagnetic fraction "q" into the zone of the high-speed fluid medium. Water is also introduced into the step 24 located at the beginning of the partition 29 so that its ascending current throws the nonmagnetic fraction "q" towards the inward wall 7 of the separator box 3, preventing thereby the intermixing of the nonmagnetic fraction "q" with the magnetic fraction "e" within the zone wherefrom the magnetic fraction "e" is being discharged from the separator.

The procedure of starting and controlling the process of wet benification of magnetic ores, using the disclosed magnetic centrifugal separator is as follows.

The controllable gate 12 (FIG. 3) in the outlet pipe 10 is opened as far as possible, and the controllable gates 12 in the outlet pipes 9 and 11 closed. The interrupters 17, 18, 19 and 23 (FIG. 8) of magnetic flux are set into operation and the gate at the header tank 43 (FIG. 12) is opened. The fluid medium of the flow "a" of the ore to be concentrated enters the inlet pipe 8 under a specified pressure and at the specified speed V. The controllable gate 12 in the outlet pipe II is opened so as to obtain a specified area of passage while the controllable gate 12 in the outlet pipe 10 is somewhat closed so as also to obtain a specified area of passage. Water under a certain pressure is admitted by means of the controllable valve 28 (FIG. 10) through the pipe 27 into the step 24 as well as into the rest of the steps not shown. The controllable gate 12 in the outlet pipe 9 (FIG. 8) is opened a small amount so as to prevent the blocking up of the pipe. The rate of rotation of the interrupter 19 at the sources 13 producing a pulsating magnetic flux of a given frequency is adjusted so that a layer of the magnetic fraction "e" is built up at the outer walls 6 of the curved portions 4. Also a layer K of coarse middlings is built up at the outer wall 6 of one of the rectilinear portions 5 with the aid of the respective interrupters of magnetic flux while a layer of the fine magnetic fraction "e" is built up at the inner wall 7 of the same rectilinear portion 5 with the aid of the interrupters 31 and 33, both layers being then discharged through the outlet pipes 10 and 35, respectively, by adjusting the velocity of these flows along with that of the flow of the tailings "d" by the respective gates 12 until some of the magnetic fraction "e" is present in the tailings "d".

After that, layers of the magnetic fraction "e" are built up at the walls 6 and 7 of the rectilinear portion 5 by applying a pulsating magnetic flux produced by the sources 14, 22 and 30, 32, respectively, in cooperation with the interrupters 18, 23 and 31, 33, respectively, the rate of rotation being controllable. The gates 12 in the outlet pipes 9 and 34 are opened by an amount providing for the discharge of the concentrate "b" with the specified content of the magnetic fraction "e" therein. During the above period, the gates in the pipes 10 and 11 must be kept closed.

The selectivity of benefication is improved by selecting the right rate of the ascending flow. This is attained by adjusting the pressure of the water introduced through the slots 26 in the steps 24 so as to intersect the flows of the magnetic fraction "e" moving in the direction from the steps 24 to the sources of magnetic flux and divert the nonmagnetic fraction "q" into the high-speed zone of the flow "a" of the ore to be concentrated. If an increase in the content of the magnetic fraction "e" is consequently noted in the tailings "d", the remedy is to open the gate 12 in the outlet pipe 10 by an amount which brings about the reduction of the content of the magnetic fraction "e" in the tailings "d" to its minimum.

The provision of sensors capable of responding to instantaneous variations in the content of the magnetic fraction "e" in the products "b", "c" and "d" of concentration yielded from the magnetic centrifugal separator so that corresponding signals are generated to control the actuators of the gates 12, paves the way to making the process of concentration a fully automatic one, provided the rest of the actuators, with which the separator is fitted, are rendered controllable at the same time. In this case, the content of the magnetic fraction "e" in the final product "b", which in fact is the concentrate, as well as the content of the magnetic fraction in the tailings "d" are kept very closely to the values specified, varying over a narrow range. The concentrate "b" obtained has the specified content of the magnetic fraction while the tailings "d" are practically free of the magnetic fraction.

The magnetic centrifugal separator of the design disclosed can be used to advantage for the dry benefication of magnetic ores, displaying an efficiency and economy which are far better than in the case of the wet benefication. The explanation is that a different fluid medium is employed, viz. air, the viscosity of which is by far lower than that of water.

If the magnetic centrifugal separator disclosed is included as an item of the equipment comprising an ore concentrating plant, the flow diagram whereof is illustrated in FIG. 12, the relevant process of concentration takes place as follows.

Crude ore is fed in metered amounts from the hopper 37 into the mill 40 by means of the feeders 38 and the belt conveyor 39 where it is reduced to particles varying in size between 4 and 0 mm. The flow "a" of the ore to be concentrated is delivered by gravity from the mill 40 into the sump 41 by way of a trough and thence is pumped into the header tank 43, using the pump 42. The header tank 43 is located at a certain height, assuring a certain constant head whereat the flow "a" of the ore to be concentrated is admitted into the magnetic centrifugal separator 44. The middlings "c" separated therein are returned into the mill 40 by gravity over a trough for reduction, the concentrate "b" of the specified quality is gravity-fed over a trough into the vacuum filter for dewatering and the tailings "d" containing the magnetic fraction "e" in a minimum amount are discharged into the tailings trough 46.

The principle of concentrating magnetic ores in the separator disclosed utilizing only the magnetic properties of minerals allows dealing with the process of concentration without the money-consuming operations of averaging both crude ore and concentrate which are commonly attendant. An additional advantage derived from the use of the separator disclosed is the prospect of eliminating from the flow diagram of the known concentrating plants almost all the screening equipment utilizing the gravitational properties of ore to be the concentrated. This equipment displays poor performance and requires much metal for its construction.

What is claimed is:

1. A method of concentrating magnetic ore comprising the steps of:

forcing a flow of magnetic ore to move in a fluid medium along guides having curved and rectilinear portions;

generating a first pulsating magnetic flux;

combining a centrifugal force, directed in the same direction as said first pulsating magnetic flux, with said first pulsating magnetic flux in said curved portions;

forcing heavy magnetic particles of said flow of magnetic ore against an outer side of said curved portions, by means of interation between said first pulsating magnetic flux, said centrifugal force and said magnetic particles, to form a layer of a magnetic fraction;

expelling less heavy nonmagnetic particles, by means of said centrifugal force, to form a layer of a nonmagnetic fraction;

generating a second pulsating magnetic flux in a direction at right angles to said flow of magnetic ore in said rectilinear portions;

slowing down said layer of the magnetic fraction in said rectilinear portions by means of said second pulsating magnetic flux; and moving said layer of the magnetic fraction at a relatively low speed and moving said layer of the nonmagnetic fraction at a relatively high speed in said flow of magnetic ore to vary the concentration of said magnetic ore.

2. A magnetic centrifugal separator for the concentration of magnetic ores comprising:

an air-tight stationary separator made of a nonmagnetic material and having an outer wall, an inner wall and curved portions alternating with rectilinear portions, the number of portions being determined by the number of magnetic fractions being separated, an inlet pipe provided at a beginning of one of said curved portions of the separator, means for introducing a flow of ore to be concentrated through said inlet pipe under a constant pressure and at a certain rate of flow, so that, within said curved portions of the separator, heavy magnetic particles are pressed to the outer wall of said separator by centrifugal force to form a layer of a magnetic fraction;

sources of magnetic flux disposed outside of, and adjacent to, said separator, some of said sources of magnetic flux being located at the curved portions of said separator and producing a magnetic flux which coincides in direction with the centrifugal force and presses said heavy magnetic particles to the outer wall of the separator to form said layer of the magnetic fraction, nonmagnetic particles which have entered the layer of the magnetic fraction being expelled to the surface of said layer, being washed out by the flow of said fluid medium travelling at a relatively higher speed and forming a layer of a nonmagnetic fraction, others of said sources of magnetic flux being located at said rectilinear portions of the separator and producing a magnetic flux which is directed at right angles to the direction of flow of ore to be concentrated, already straightened out, and which presses the magnetic fraction to the outer wall of the separator, the lower the strength of the magnetic field the fewer concentrations of the mineral being attracted to the wall of the separator and the more such concentrations being washed out by the flow of fluid medium travelling rectilinearly at a relatively higher speed;

an interrupter of magnetic flux in the form of a multisection unit interposed between said portions of the separator and said sources of magnetic flux, some of the sections thereof being located at the curved portions of said separator and others of said sections being located at the rectilinear portions, all the sections of said interrupter of magnetic flux corresponding to the contours of those portions of the seperator at which they are located;

controllable drives linked with said sections of the interrupter of magnetic flux and imparting to each of them movement, so that the magnetic flux produced pulsates, which recurrently acts on said magnetic fraction of the flow of ore to be concentrated, the frequency of the pulses and and the duration of their action on the magnetic fraction varying with the rate of movement of the respective section of the interrupter of magnetic flux;

an outlet pipe provided at the end of at least the first rectilinear portion for the discharge of said magnetic fraction in the form of a concentrate, and separate outlet pipes for the discharge of middlings and tailings, the flow of the magnetic fraction travelling at a relatively low speed accumulating in said outlet pipes and being discharged therefrom due to the force of the velocity of the fluid medium;

controllable gates provided in each of said outlet pipes, the area of passage of the gates, serving to control the amount of the product being discharged therethrough and the content of the magnetic fraction in each of said products and the area of passage of all the gates serving to control the speed of the flow of fluid medium.

3. A magnetic centrifugal separator as claimed in claim 2 wherein each section of said interrupter of magnetic flux is a moving endless belt of a nonmagnetic material with ports, the transverse separations between said ports being made of a magnetic material, the size and rate of travel of the ports when said belt is set into motion controlling the duration of the pulses of magnetic flux, which build up said layer of the magnetic fraction and contribute to the reduction of size of floccules in said layer.

4. A magnetic centrifugal separator as claimed in claim 2, wherein said interrupter of magnetic flux located at said curved portions of the separator box is a cylinder surrounding all the curved portions.

5. A magnetic centrifugal separator as claimed in claim 2, wherein said sections of the interrupter of magnetic flux located at said rectilinear portions of the separator box are elliptical.

6. A magnetic centrifugal separator as claimed in claim 2 wherein all said sources of magnetic flux located at said rectilinear portions of the separator box are controllable, the changing of their magnetic flux affecting the content of the magnetic fraction in said flow of magnetic ore to be concentrated.

7. A magnetic centrifugal separator as claimed in claim 2, wherein said controllable drives impart rotary movement to each of said sections of the interrupter of magnetic flux, the frequency and duration of the pulses of said pulsating magnetic flux changing with the rate of rotation of said sections.

8. A magnetic centrifugal separator as claimed in claim 2 wherein said controllable drives impart reciprocative movement to each of said section of the interrupter of magnetic flux, the frequency and duration of the pulses of said pulsating magnetic flux changing with the rate of reciprocation of said sections.

9. A magnetic centrifugal separator for the concentration of magnetic ores comprising:

an air-tight stationary separator made of a nonmagnetic material and having an outer wall, an inner wall and curved portions alternating with rectilinear portions, the number of portions being determined by the number of magnetic fractions being separated, an inlet pipe provided at a beginning of one of said curved portions of the separator, means for introducing a flow of ore to be concentrated through said inlet pipe under a constant pressure and at a certain rate of flow, so that, within said curved portions of the separator, heavy magnetic particles are pressed to the outer wall of said separator by centrifugal force to form a layer of a magnetic fraction;

sources of magnetic flux disposed outside of, and adjacent to, said separator and consisting of several separate groups, a first group of said sources of magnetic flux being located at said curved portions of the separator and producing a magnetic flux which coincides in direction with said centrifugal force and presses said heavy magnetic particles to the outer wall of the separator to form said layer of the magnetic fraction, nonmagnetic particles which have entered the layer of the magnetic fraction being expelled to the surface of said layer, being washed out by the flow of said fluid medium travelling at a relatively higher speed and forming a layer of a nonmagnetic fraction, a second group of said sources of magnetic flux being located at the outer side of said rectilinear portions of the separator, upstream of the place where the magnetic fraction is being discharged, which produces a magnetic flux directed at right angles to the direction of the flow of ore to be concentrated and presses the magnetic particle to the outer wall of the separator, the lower the strength of the magnetic field the fewer concentrations of the mineral being attracted to said outer wall of the separator and the more said concentrations being washed out by the flow of said fluid medium travelling rectilinearly at a relatively higher speed, a third group of said sources of magnectic flux located at an outer side of said rectilinear portion of said separator, downstream of the place where the magnetic fraction is being discharged, to accumulate that portion of the magnetic fraction which said preceding sources of magnetic flux have failed to separate, a fourth group of said sources of magnetic flux located at an inner side of said rectilinear portion of the separator, upstream of the place where the magnetic fraction is being discharged, to build up a layer of the fine magnetic fraction which the sources of magnetic flux located at the outer side of said portion have filed to attract, a fifth group of said sources of magnetic flux located downstream of the place where the magnetic fraction is being discharged and at the inner side of said rectilinear portion of the separator to accumulate the fine magnetic fraction which the sources of magnetic flux located upstream of said place where the fine magnetic fraction is being discharged and at the inner side of said rectilinear portion have failed to separate;

an interrupter of magnetic flux in the form of a multisection unit interposed between said portions of the separator and said sources of magnetic flux, some of the sections thereof being located at the curved portions of the separator and others of said sections being located at the rectilinear portions, all the sections of said interrupter of magnetic flux corresponding to the contours of those portions of the separator at which they are being fitted, each of said sections being a moving endless belt of a magnetic material with ports, the transverse separations between said ports being made of a magnetic material, so that a pulsating magnetic flux recurrently acting on said magnetic fraction of the flow of the ore to be concentrated is produced, the frequency of the pulses and the duration of their action on the magnetic fraction varying with the rate of rotation of said interrupter of magnetic flux;

at least one hollow step located inside said air-tight separator at the outer wall, said step widening in the direction of travel of said flow of the ore to be concentrated and being provided with a slot in an end face;

pipes with controllable valves connected to spaces inside said steps, through which another fluid medium is pressure-fed, the ascending current whereof which leaves said slot washing said flow of the magnetic fraction;

partitions of a nonmagnetic material provided along said curved and rectilinear portions of the separator downstream of said steps in the direction of travel of said flow of the ore to be concentrated, which prevent the intermixing of the separated flows of the magnetic and nonmagnetic fractions travelling along the separator and prevent the ingress of particles of the nonmagnetic fraction into the built-up layer of the magnetic fraction;

outlet pipes, two for each rectilinear portion, provided at the end of each rectilinear portion of the separator at said inner and outer sides for the discharge of said magnetic fraction and middlings, respectively, separated from the flow of the ore to be concentrated;

an additional outlet pipe provided at the end of the last rectilinear portion of said separator for the discharge, due to the force of the velocity of the fluid medium, of the tailings; and controllable gates provided in each of said outlet pipes, the area of passage whereof controlling the amount of the respective magnetic particles discharged therethrough, the area of passage of all said gates controlling the speed of flow of said fluid medium.

* * * * *